US009340009B2

(12) United States Patent
Murayama et al.

(10) Patent No.: US 9,340,009 B2
(45) Date of Patent: May 17, 2016

(54) PRINTING APPARATUS AND PROCESSING METHOD THEREFOR

(71) Applicant: CANON KABUSHIKI KAISHA, Tokyo (JP)

(72) Inventors: Yoshiaki Murayama, Tokyo (JP); Satoshi Azuma, Kawasaki (JP); Kei Kosaka, Yokohama (JP); Makoto Torigoe, Tokyo (JP); Shigeyasu Nagoshi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/679,252

(22) Filed: Apr. 6, 2015

(65) Prior Publication Data

US 2015/0210070 A1 Jul. 30, 2015

Related U.S. Application Data

(63) Continuation of application No. 12/964,070, filed on Dec. 9, 2010, now abandoned.

(30) Foreign Application Priority Data

Aug. 5, 2010 (JP) ..... 2010-176708

(51) Int. Cl.
*B41J 2/045* (2006.01)
*B41J 2/21* (2006.01)
*B41J 29/393* (2006.01)

(52) U.S. Cl.
CPC ..... *B41J 2/04508* (2013.01); *B41J 2/04586* (2013.01); *B41J 2/2135* (2013.01); *B41J 2/2146* (2013.01); *B41J 29/393* (2013.01)

(58) Field of Classification Search
CPC ..... B41J 2/2135; B41J 29/393; B41J 2029/3935; B41J 2/04505; B41J 2/04508; B41J 2/04586; B41J 2/2132; B41J 2/04573; B41J 2/2146; B41J 19/145; B41J 2/04501; B41J 11/42; B41J 19/205
See application file for complete search history.

(56) References Cited

U.S. PATENT DOCUMENTS 5,992,968 A 11/1999 Uetsuki et al.
6,761,426 B2 7/2004 Tsuchiya et al.

(Continued)

FOREIGN PATENT DOCUMENTS

JP 2001001510 A 1/2001
JP 2002079657 A 3/2002
JP 2003118087 A 4/2003
JP 2004181697 A 7/2004

(Continued)

*Primary Examiner* — Thinh Nguyen
(74) *Attorney, Agent, or Firm* — Fitzpatrick, Cella, Harper & Scinto

(57) ABSTRACT

A printing apparatus includes a full-line printhead in which a plurality of chips, on each of which a plurality of nozzle arrays are juxtaposed, are arranged in the nozzle arrayed direction, and which prints by the entire width of a printing medium using a plurality of nozzles arranged on the plurality of chips. The printing apparatus discharges ink from a predetermined number of successive nozzles on each nozzle array of each chip toward a printing medium during conveyance, thereby forming a plurality of first patterns corresponding to at least one nozzle array of each chip on the printing medium in the nozzle arrayed direction, reads the plurality of first patterns from the printing medium during conveyance using a sensor, calculates the shift amount of an ink attached position based on the plurality of read first patterns and corrects the attached position of ink based on the shift amount.

17 Claims, 12 Drawing Sheets

(56) References Cited

U.S. PATENT DOCUMENTS

| | | | | |
|---|---|---|---|---|
| 7,216,948 | B2 | 5/2007 | Matsuzaki et al. | |
| 2005/0179710 | A1 | 8/2005 | Tatsuta et al. | |
| 2009/0002415 | A1 | 1/2009 | Teshigawara et al. | |
| 2009/0315934 | A1 | 12/2009 | Moriyama et al. | |
| 2012/0026229 | A1 | 2/2012 | Kato et al. | |
| 2012/0069067 | A1 | 3/2012 | Torigoe et al. | |
| 2012/0188301 | A1* | 7/2012 | Tomida | B41J 2/2132 347/14 |
| 2015/0165760 | A1* | 6/2015 | Murayama | B41J 2/04505 347/12 |

FOREIGN PATENT DOCUMENTS

| | | | |
|---|---|---|---|
| JP | 2005053167 | A | 3/2005 |
| JP | 2009006676 | A | 1/2009 |
| JP | 4312057 | B2 | 8/2009 |
| JP | 2010105203 | A | 5/2010 |
| JP | 2011245802 | A | 12/2011 |

* cited by examiner

PRINTING APPARATUS AND PROCESSING METHOD THEREFOR

This application is a continuation of application Ser. No. 12/964,070 filed Dec. 9, 2010, which in turn claims benefit of Japanese Application No. 2010-176708 filed Aug. 5,2010.

BACKGROUND OF THE INVENTION

1. Field of the Invention

The present invention relates to a printing apparatus and processing method therefor.

2. Description of the Related Art

There is known a printing apparatus that has a so-called full-line printhead, whose printing width corresponds to a printing medium width. In a printhead of this type, a plurality of printheads are arranged with a shift in the nozzle arrayed direction. A printing apparatus having such a printhead can print an image on almost the entire surface of a printing medium by relatively moving the printhead once with respect to the printing medium.

If an error occurs in the mounting position of the printhead or the relative mounting positions of a plurality of printheads in the full-line printhead, the ink landing position (attached position) may shift owing to the error. This shift degrades the printing quality.

To cope with the shift of the landing position, Japanese Patent Laid-Open No. 2004-181697 discloses the technique of reading a test pattern using a CCD line sensor, and correcting the landing position based on the reading result.

In contrast, Japanese Patent Laid-Open No. 2010-105203 discloses a technique of calculating the relative positions of patterns using pattern matching. This technique can shorten the adjustment time and decrease the test pattern length because it is sufficient to perform adjustment only once. More specifically, the same pattern is repeatedly printed on a printing medium and read using a CCD line sensor, measuring the relative distance between the patterns.

A case in which a test pattern is formed on a printing medium using a printhead, and read on the downstream side of the printhead while conveying the printing medium will be examined. In this case, a printing medium conveyance shift may occur in the arrangement disclosed in Japanese Patent Laid-Open No. 2004-181697. When the conveyance shift occurs, the test pattern size changes, failing to accurately read the test pattern. In the arrangement disclosed in Japanese Patent Laid-Open No. 2010-105203, the size of a read image differs between patterns to be matched, increasing the measurement error.

SUMMARY OF THE INVENTION

The present invention provides a technique capable of reducing the measurement error even when a printing medium conveyance shift occurs in reading a pattern.

According to one aspect of the present invention, there is provided a printing apparatus that includes a full-line printhead in which a plurality of chips, on each of which a plurality of nozzle arrays are juxtaposed, are arranged in a nozzle arrayed direction, and which prints by an entire width of a printing medium using a plurality of nozzles arranged on the plurality of chips, and that prints on the printing medium by discharging ink from the respective nozzles of the printhead while conveying the printing medium in a direction perpendicular to the nozzle arrayed direction, the apparatus comprising: a pattern forming control unit configured to control discharging ink from a predetermined number of successive nozzles on each nozzle array of each chip toward the printing medium during conveyance, thereby forming a plurality of first patterns corresponding to at least one nozzle array of each chip on the printing medium in the nozzle arrayed direction; a reading unit configured to read the plurality of first patterns from the printing medium during conveyance using a sensor so configured as to arrange a plurality of reading elements in the nozzle arrayed direction and make a reading width defined by the plurality of reading elements cover at least part of a printing width of the printhead; a calculation unit configured to calculate a shift amount of an ink attached position from an ideal ink attached position based on a positional relationship between the plurality of first patterns read by the reading unit; and a correction unit configured to correct an attached position of ink discharged from each nozzle of the printhead based on the shift amount calculated by the calculation unit.

According to another aspect of the present invention, there is provided a processing method for a printing apparatus that includes a full-line printhead in which a plurality of chips, on each of which a plurality of nozzle arrays are juxtaposed, are arranged in a nozzle arrayed direction, and which prints by an entire width of a printing medium using a plurality of nozzles arranged on the plurality of chips, and that prints on the printing medium by discharging ink from the respective nozzles of the printhead while conveying the printing medium in a direction perpendicular to the nozzle arrayed direction, the method comprising: discharging ink from a predetermined number of successive nozzles on each nozzle array of each chip toward the printing medium during conveyance, thereby forming a plurality of first patterns corresponding to at least one nozzle array of each chip on the printing medium in the nozzle arrayed direction; reading the plurality of first patterns from the printing medium during conveyance using a sensor so configured as to arrange a plurality of reading elements in the nozzle arrayed direction and make a reading width defined by the plurality of reading elements cover at least part of a printing width of the printhead; calculating a shift amount of an ink attached position from an ideal ink attached position based on a positional relationship between the plurality of read first patterns; and correcting an attached position of ink discharged from each nozzle of the printhead based on the calculated shift amount.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. The printing apparatus may be, for example, a single-function printer having only a printing function, or a multifunction printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramic, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

(First Embodiment)

Figure 1:
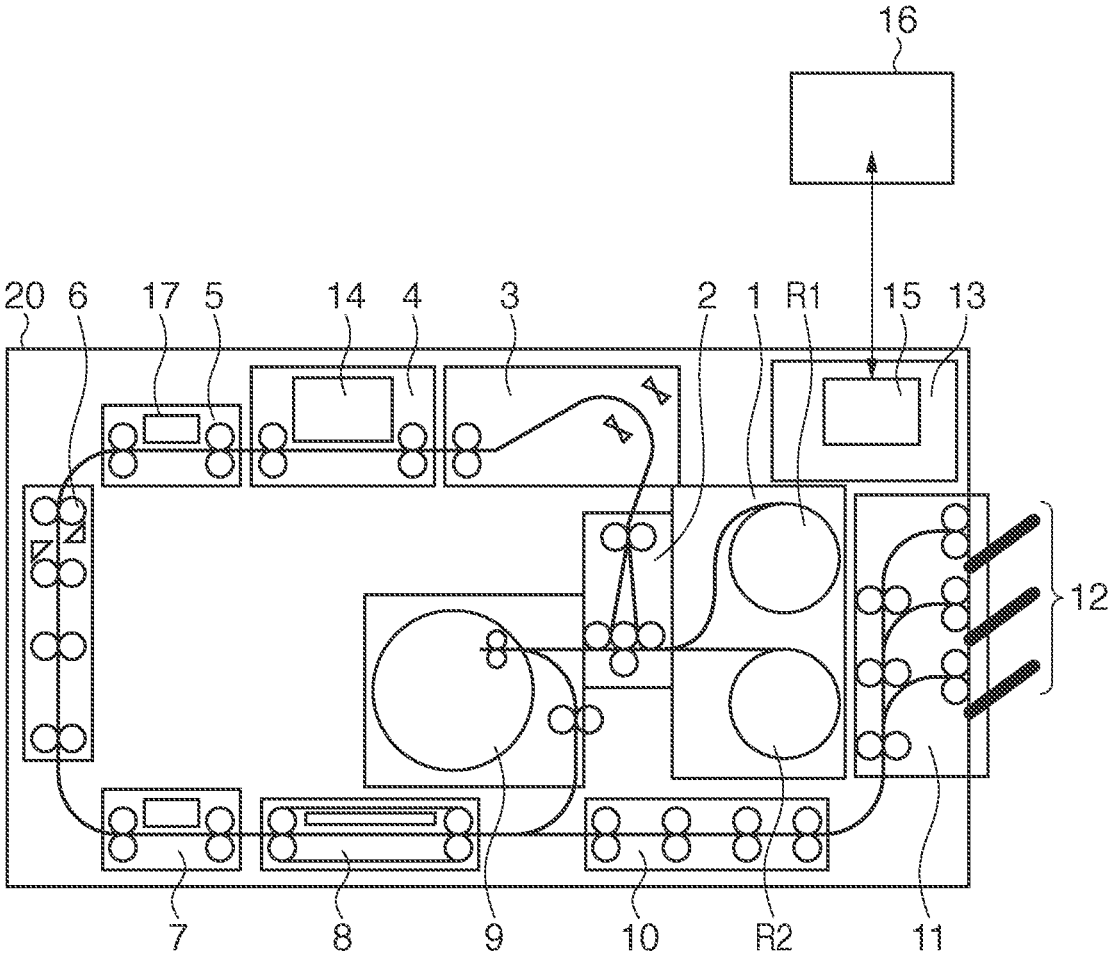
FIG. 1 is a sectional view exemplifying the internal arrangement of an inkjet printing apparatus according to an embodiment of the present invention.

FIG. 1 is a sectional view exemplifying the internal arrangement of an inkjet printing apparatus (to be simply referred to as a printing apparatus) 20 according to an embodiment of the present invention. As the printing apparatus 20 according to the embodiment, a high-speed line printer which uses a continuous sheet, such as a roll of sheet, and copes with both single-sided printing and double-sided printing will be exemplified. This printing apparatus is suited to, for example, the field of many prints in a print lab or the like.

The printing apparatus 20 incorporates a sheet supply unit 1, decurling unit 2, skew correction unit 3, printing unit 4, inspection unit 5, cutter unit 6, information printing unit 7, drying unit 8, sheet take-up unit 9, and discharge conveyance unit 10. In addition, the printing apparatus 20 incorporates a sorter unit 11, discharge trays 12, and a control unit 13.

A conveyance mechanism made up of roller pairs and a belt conveys a printing medium (sheet in this case) along a sheet conveyance path (indicated by solid lines in FIG. 1). On the conveyance path, the respective units of the printing apparatus 20 perform various processes for the sheet.

The sheet supply unit 1 stores and supplies a continuous sheet wound like a roll. The sheet supply unit 1 can store two rolls R1 and R2, and alternatively pulls out and supplies the sheet. Note that the number of storable rolls need not always be two, and the sheet supply unit 1 may store one, or three or more rolls.

The decurling unit 2 reduces the curl (warpage) of a sheet supplied from the sheet supply unit 1. The decurling unit 2 warps the sheet using two pinch rollers for one driving roller so as to give a warpage in an opposite direction, thereby reducing the curl of the sheet.

The skew correction unit 3 corrects the skew (tilt from an original traveling direction) of the sheet having passed through the decurling unit 2. The skew correction unit 3 corrects the skew of the sheet by pressing the reference end of the sheet against a guide member.

The printing unit 4 forms and prints an image on a conveyed sheet. The printing unit 4 includes a plurality of inkjet printheads (to be simply referred to as printheads) 14, in addition to a plurality of conveyance rollers for conveying a sheet. Each printhead 14 is a full-line printhead, and has a printing width corresponding to the maximum width of a sheet, the use of which is assumed.

The printheads 14 are juxtaposed in the conveyance direction. In the embodiment, four printheads corresponding to four, K (blacK), C (Cyan), M (Magenta), and Y (Yellow) are arranged. The printheads are arranged in order of K, C, M, and Y from the upstream side in the sheet conveyance direction with their printing widths that are aligned with each other in a nozzle arrayed direction. Note that the number of colors and that of printheads need not always be four and can be appropriately changed. The inkjet method can be a method using a heat generation element, one using a piezoelectric element, one using an electrostatic element, one using a MEMS element, or the like. The respective color inks are supplied from ink tanks to the printheads 14 via ink tubes.

The inspection unit 5 includes, for example, a CCD line sensor 17. The CCD line sensor 17 is formed from, for example, a two-dimensional image sensor, and a plurality of reading elements are aligned in a direction (nozzle arrayed direction) perpendicular to the sheet conveyance direction. In addition, the inspection unit 5 includes a light-emitting element or the like. With this arrangement, the inspection unit 5 optically reads a pattern or image printed on a sheet by the printing unit 4, and inspects the nozzle state of the printhead 14, the sheet conveyance state, the image position, and the like.

The cutter unit 6 cuts a sheet bearing an image into a predetermined length. The cutter unit 6 includes a plurality of conveyance rollers for conveying a sheet to the next process.

The information printing unit 7 prints information such as a serial number and date on the reverse of a sheet. The drying unit 8 dries applied ink (within a short time) by heating a sheet on which the printing unit 4 has printed an image. The drying unit 8 includes a conveyance belt and conveyance roller for conveying a sheet to the next process.

The sheet take-up unit 9 temporarily takes up a continuous sheet having undergone printing on the obverse of a sheet in double-sided printing. The sheet take-up unit 9 includes a take-up drum which rotates to take up a sheet. After printing on the obverse of a sheet, the take-up drum temporarily takes up the continuous sheet which is not cut by the cutter unit 6.

After take-up, the take-up drum rotates backward to send the taken-up sheet to the printing unit 4 via the decurling unit 2. This sheet has been turned over, so the printing unit 4 can print on the reverse of the sheet. A detailed operation in double-sided printing will be described later.

The discharge conveyance unit 10 conveys, to the sorter unit 11, a sheet which has been cut by the cutter unit 6 and dried by the drying unit 8. The sorter unit 11 discharges the sheet bearing an image to the discharge tray 12. At this time, the sorter unit 11 may sort and discharge sheets to the difference discharge trays 12.

The control unit 13 controls the respective units of the printing apparatus 20. The control unit 13 includes a controller 15 having a CPU, memory, various I/O interfaces, and the like, and a power supply unit. The operation of the printing apparatus 20 is controlled based on an instruction from the controller 15 or an external device 16 (for example, host computer) connected to the controller 15 via an I/O interface.

A basic operation sequence in print processing will be explained with reference to FIGS. 2A and 2B. The print processing differs between single-sided printing and double-sided printing, and thus will be explained for each printing.

Figure 2A:
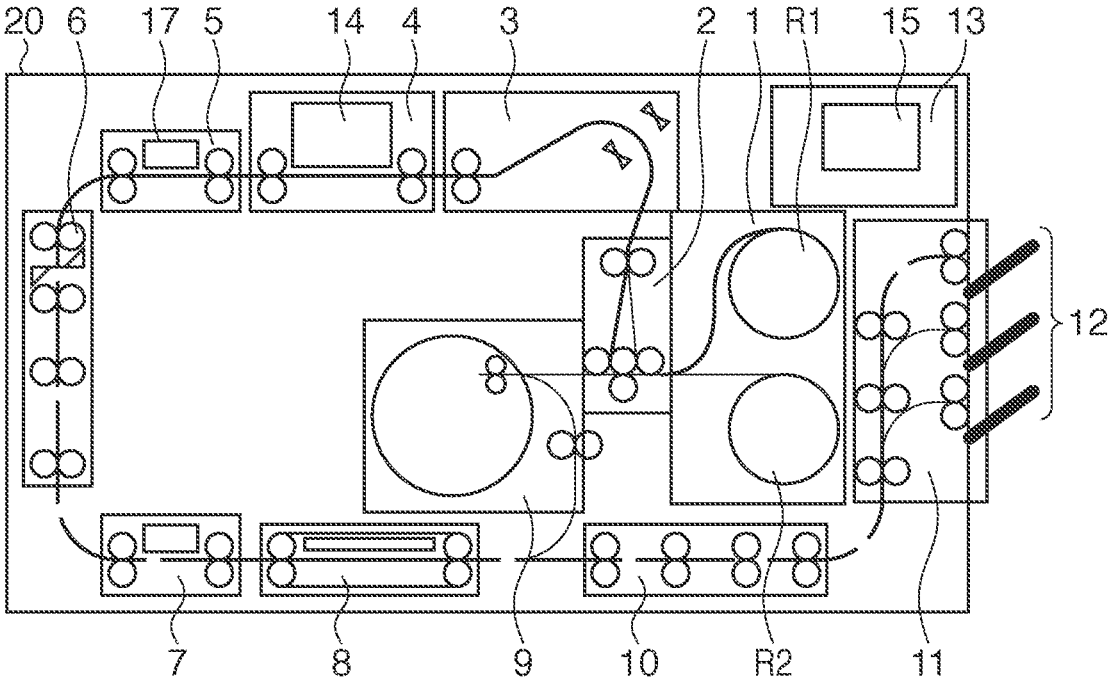
FIGS. 2A and 2B are sectional views for explaining print processing sequences in single-sided printing and double-sided printing.

FIG. 2A is a sectional view for explaining an operation in single-sided printing. In FIG. 2A, bold lines indicate a conveyance path until a sheet is discharged to the discharge tray 12 after an image is printed on the sheet supplied from the sheet supply unit 1.

When the sheet supply unit 1 supplies a sheet, the decurling unit 2 and skew correction unit 3 perform processes for it, and the printing unit 4 prints an image on the obverse of the sheet. The sheet bearing the image passes through the inspection unit 5 and is cut into every predetermined length by the cutter unit 6. If necessary, the information printing unit 7 prints information such as a date on the reverse of the cut sheet. After the drying unit 8 dries the sheets one by one, the sheets are discharged onto the discharge tray 12 of the sorter unit 11 via the discharge conveyance unit 10.

Figure 2B:
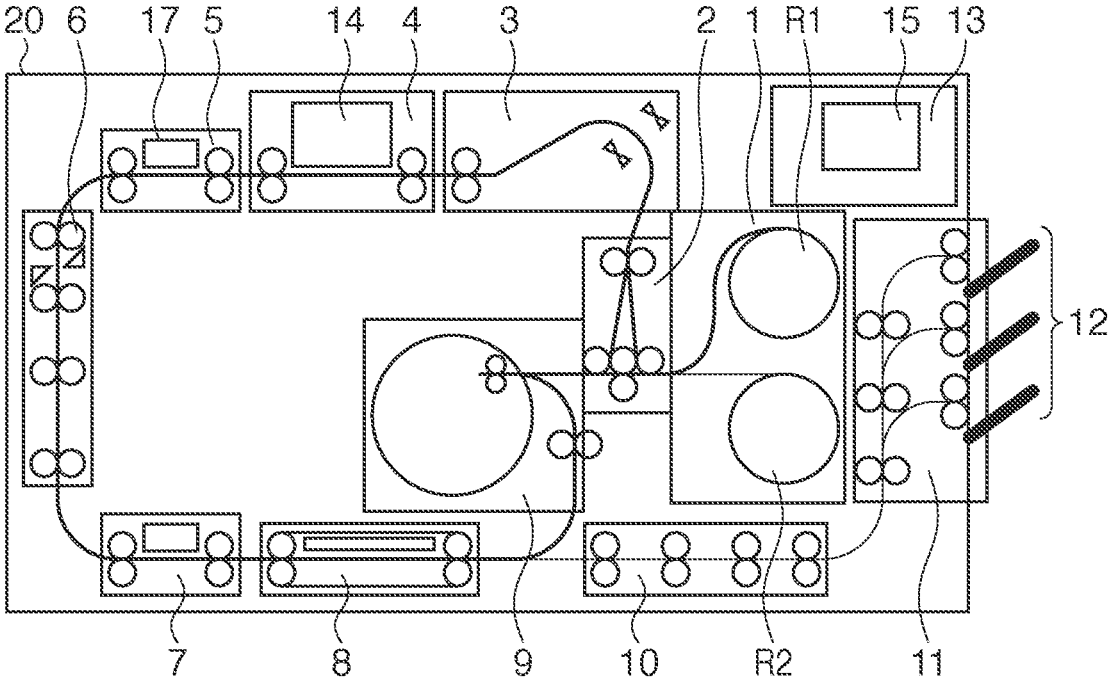

FIG. 2B is a sectional view for explaining an operation in double-sided printing. In double-sided printing, a printing sequence for the reverse of a sheet is executed subsequently to a printing sequence for the obverse of the sheet. In FIG. 2B, bold lines indicate a conveyance path when printing an image on the obverse of a sheet in double-sided printing.

The operations of the respective units from the sheet supply unit 1 to the inspection unit 5 are the same as those in single-sided printing explained with reference to FIG. 2A. The difference is processes by the cutter unit 6 and subsequent units. More specifically, when a sheet is conveyed to the cutter unit 6, the cutter unit 6 cuts the trailing end of the printing region of the continuous sheet without cutting the sheet into every predetermined length. When the sheet is conveyed to the drying unit 8, the drying unit 8 dries ink on the obverse of the sheet, and then the sheet is conveyed not to the discharge conveyance unit 10 but to the sheet take-up unit 9. The conveyed sheet is taken up by the take-up drum of the sheet take-up unit 9 which rotates forward (counterclockwise in FIG. 2B). More specifically, the take-up drum takes up the sheet up to its trailing end (cut position). Note that the sheet supply unit 1 rewinds a continuous sheet on the upstream side in the conveyance direction from the cut position of the sheet cut by the cutter unit 6 so that the leading end (cut position) of the sheet is not left in the decurling unit 2.

After the end of the printing sequence for the obverse of the sheet, a printing sequence for the reverse of the sheet starts. After this sequence starts, the take-up drum rotates in a direction (clockwise in FIG. 2B) opposite to the take-up direction. The end of the taken-up sheet (trailing end of the sheet in take-up serves as the leading end of the sheet in feed) is conveyed to the decurling unit 2. The decurling unit 2 corrects the curl of the sheet in a direction opposite to one in image printing on the obverse of the sheet. This is because the sheet taken up by the take-up drum is wound with its surface turned over from the roll in the sheet supply unit 1, and is curled in the opposite direction.

The sheet passes through the skew correction unit 3 and is conveyed to the printing unit 4, which prints an image on the reverse of the sheet. The sheet bearing the image passes through the inspection unit 5 and is cut into every predetermined length by the cutter unit 6. Since images are printed on the two surfaces of the cut sheet, the information printing unit 7 does not print information such as a date. Thereafter, the sheet passes through the drying unit 8 and discharge conveyance unit 10, and is discharged onto the discharge tray 12 of the sorter unit 11.

Figure 3:
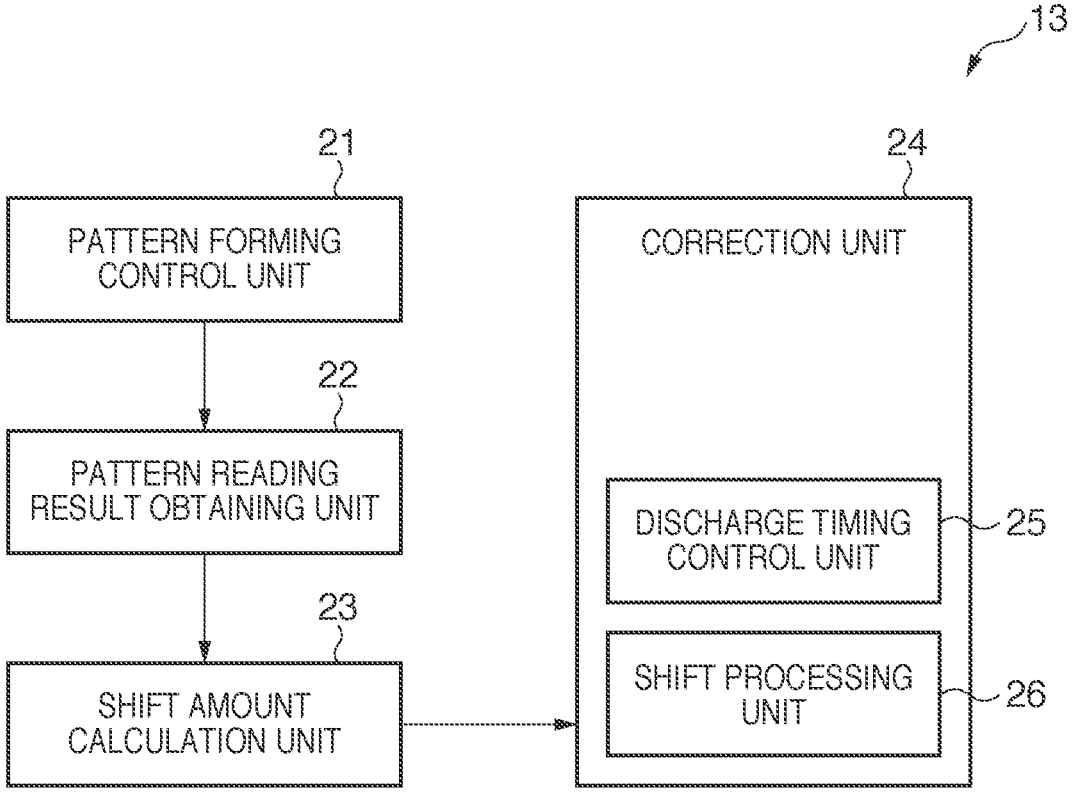
FIG. 3 is a block diagram exemplifying a functional arrangement implemented by a control unit 13 shown in FIG. 1.

A functional arrangement implemented by the control unit 13 shown in FIG. 1 will be exemplified with reference to FIG. 3. For example, the CPU implements the functional arrangement shown in FIG. 3 by loading programs stored in the memory or the like.

As the functional arrangement, the control unit 13 includes a pattern forming control unit 21, pattern reading result obtaining unit 22, shift amount calculation unit 23, and correction unit 24.

The pattern forming control unit 21 controls printing of an adjustment pattern for measuring a shift of the landing position (attached position) of ink discharged from each nozzle array of each printhead 14. Although details of the adjustment pattern will be described later, the adjustment pattern has a layout shown in FIG. 5.

The pattern reading result obtaining unit 22 obtains the reading result of the adjustment pattern printed on a printing medium (sheet). Note that the adjustment pattern is read using, for example, the reading elements of the CCD line sensor 17 arranged in the inspection unit 5.

Based on the adjustment pattern reading result, the shift amount calculation unit 23 calculates a shift amount generated from a manufacturing error, mounting error, or the like in a printhead and between printheads. In other words, the shift amount calculation unit 23 calculates the shift amount of an actual ink landing position with respect to an ideal ink landing position.

Based on the shift amount calculated by the shift amount calculation unit 23, the correction unit 24 corrects a shift of the landing position of ink discharged from the nozzle of each printhead. The correction unit 24 includes a discharge timing control unit 25 which controls the discharge timing of ink from each nozzle, and a shift processing unit 26 which shifts the region of nozzles used in printing. This arrangement is an example of the functional arrangement implemented in the control unit 13.

Figure 4:
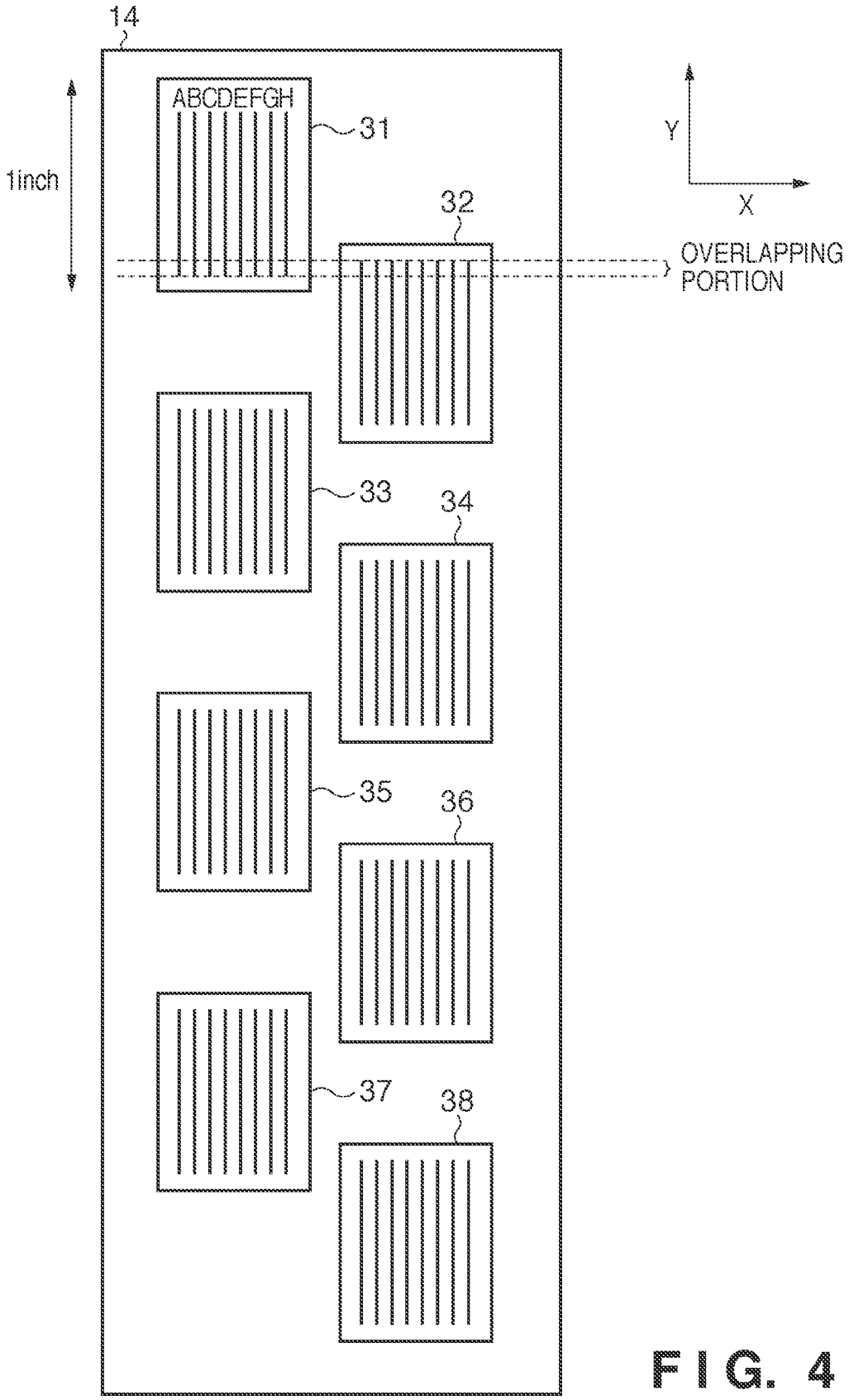
FIG. 4 is a view exemplifying the arrangement of a printhead 14 shown in FIG. 1.

The arrangement of the printhead 14 in the printing apparatus 20 shown in FIG. 1 will be exemplified with reference to FIG. 4. The respective printheads have the same arrangement, so only one of them will be exemplified.

The printheads 14 are printheads for four, black (K), cyan (C), magenta (M), and yellow (Y). The sheet conveyance direction is defined as the X direction, and a direction perpendicular to the sheet conveyance direction is defined as the Y direction. The definitions of the X and Y directions also apply to the subsequent drawings.

In the printhead 14, for example, eight silicon chips 31 to 38 each having an effective discharge width of about 1 inch are staggered on a base substrate (support member). The chip is electrically connected to a flexible wiring board by wire bonding via electrodes at two ends in the nozzle arrayed direction.

On each of the chips 31 to 38, a plurality of nozzle arrays are arranged. More specifically, eight nozzle arrays A, B, C, D, E, F, G, and H are juxtaposed. The chips 31 to 38 overlap each other by a predetermined number of nozzles. More specifically, some nozzles of nozzle arrays on chips adjacent to each other overlap in the Y direction (nozzle arrayed direction).

Each of the chips 31 to 38 includes, for example, a temperature sensor (not shown) for measuring the chip temperature. For each nozzle (orifice), for example, a printing element (heater) formed from a heat generation element is arranged. The printing element heats a liquid by energization to bubble it, and discharges it from an orifice by the kinetic energy.

The printhead 14 has an effective discharge width of about 8 inches, which almost coincides with the length of the short side of an A4 printing sheet. By 1-pass scanning, the printhead 14 can complete printing of an image.

The adjustment pattern for measuring a shift of the landing position of ink discharged from the printhead 14 shown in FIG. 4 will be explained with reference to FIGS. 5 to 7.

Figure 5:
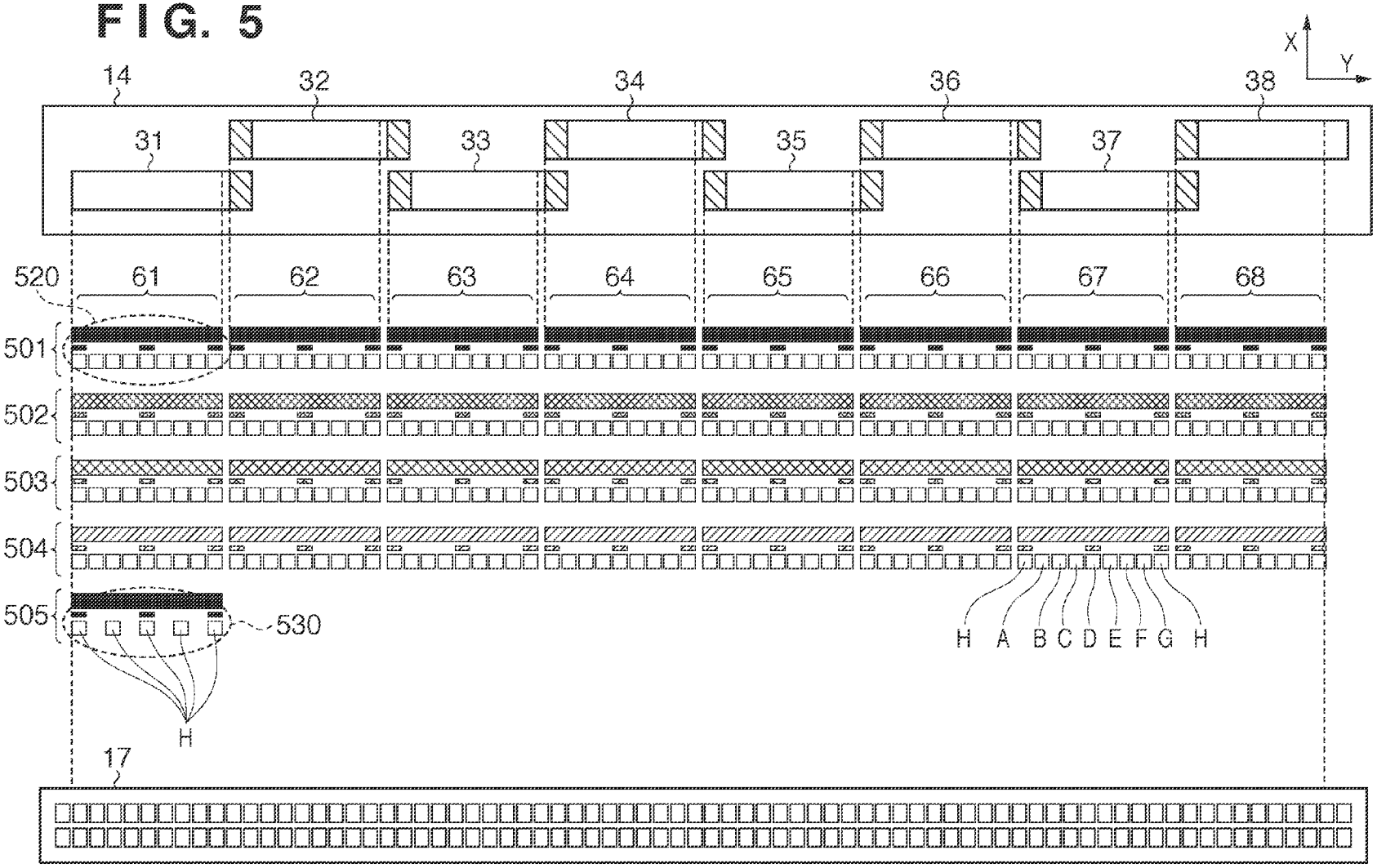
FIG. 5 is a view exemplifying the layout of an adjustment pattern.

FIG. 5 exemplifies the layout of the adjustment pattern. The adjustment pattern includes a plurality of individual patterns. The printhead 14 is illustrated on the upper side of FIG. 5, and the CCD line sensor 17 is illustrated on the lower side of FIG. 5. Individual patterns 61 to 68 are aligned in the longitudinal direction in FIG. 5. Each individual pattern is printed by a chip whose number at the last digit matches that of the individual pattern. For example, the chip 31 prints the individual pattern 61.

The black (K) printhead prints individual patterns 501 aligned in the lateral direction, and the cyan (C) printhead prints individual patterns 502 aligned in the lateral direction. The magenta (M) printhead prints individual patterns 503 aligned in the lateral direction, and the yellow (Y) printhead prints individual patterns 504 aligned in the lateral direction.

The shift (X) between nozzle arrays, the shifts (X, Y) between chips, and the tilt of a chip are measured from the individual patterns 501 to 504. Also, the relative positional shifts (X, Y) between printheads are measured from an individual pattern 505.

Figure 6A:
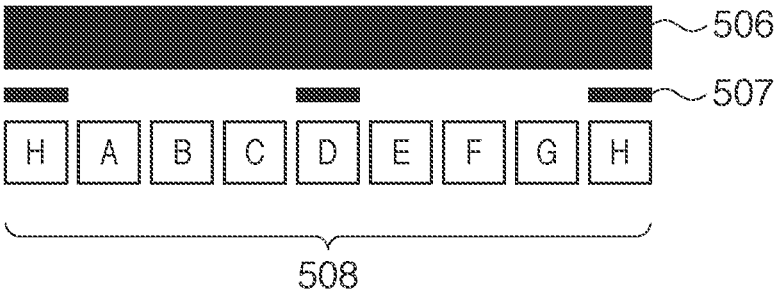
FIGS. 6A and 6B are enlarged views of individual patterns shown in FIG. 5.
Figure 7:
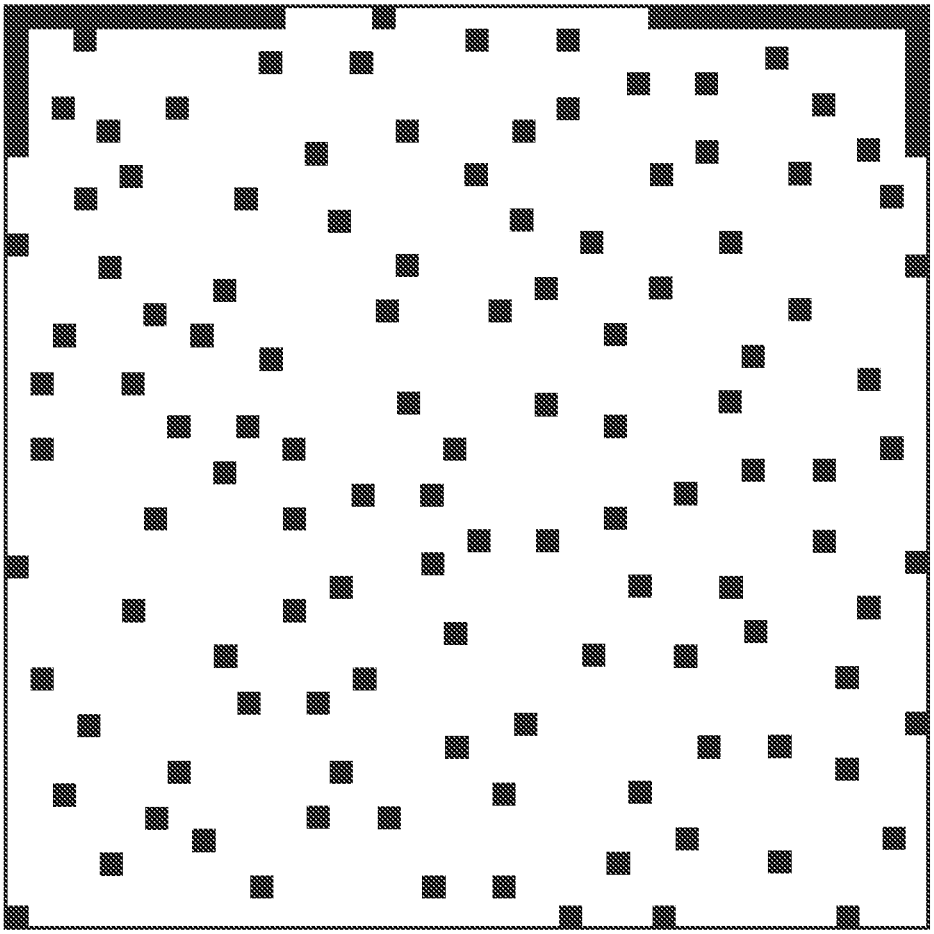
FIG. 7 is a view exemplifying tile patterns.

FIG. 6A is an enlarged view of an individual pattern in a dotted frame 520 shown in FIG. 5. A detection bar 506 is used to detect the color of a pattern when analyzing an image read by the CCD line sensor 17. For example, if the R channel value of an RGB image which forms the detection bar 506 is smaller than 10, the CPU detects that the current pattern is a K pattern. If the R channel value falls within the range of 10 (inclusive) to 60 (inclusive), the CPU detects that the current pattern is a C pattern. If the G channel value falls within the range of 10 (inclusive) to 60 (inclusive), the CPU detects that the current pattern is an M pattern. If the B channel value falls within the range of 10 (inclusive) to 60 (inclusive), the CPU detects that the current pattern is a Y pattern.

Reference numeral 507 denotes each reference mark; and 508, each tile pattern (first pattern) used in pattern matching. The tile patterns 508 are detected using the reference marks 507 as a reference, and formed at positions spaced apart from the reference marks 507 by a predetermined number of pixels. All the tile patterns 508 are formed from the same pattern, and printed by different nozzle arrays on the same chip. More specifically, the tile patterns 508 are printed using a predetermined number of successive nozzles of nozzle arrays arranged on the same chip. Note that the predetermined number of successive nozzles do not overlap each other on respective nozzle arrays in the nozzle arrayed direction. Printing of the patterns does not always use all nozzle arrays arranged on the same chip; it suffices to print using at least one nozzle array. Letters attached to the respective tile patterns indicate nozzle arrays used in printing.

Figure 6B:
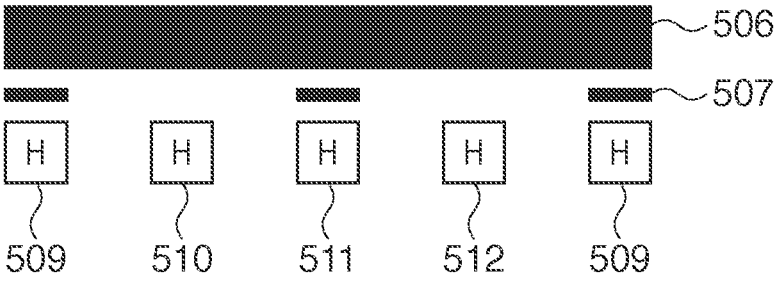

FIG. 6B is an enlarged view of an individual pattern in a dotted frame 530 shown in FIG. 5. As described above, the relative positional shifts between printheads can be measured from this individual pattern.

Similar to the pattern shown in FIG. 6A, the individual pattern shown in FIG. 6B includes the detection bar 506 and reference marks 507. In this individual pattern, tile patterns (second patterns) 509 to 512 used in pattern matching are also formed.

The black (K) printhead prints the tile pattern 509, and the cyan (C) printhead prints the tile pattern 510. The magenta (M) printhead prints the tile pattern 511, and the yellow (Y) printhead prints the tile pattern 512. All the tile patterns 509 to 512 are formed from the same pattern, and printed by the same nozzle array (nozzle array H in the embodiment). More specifically, the tile patterns 509 to 512 are printed using a nozzle array arranged at a predetermined position on a chip arranged at a corresponding position in each printhead. The tile patterns shown in FIGS. 5, 6A, and 6B form a random dot pattern, as shown in FIG. 7.

As shown in FIG. 5, all the tile patterns are aligned in a direction (Y direction) parallel to the alignment of reading elements in the CCD line sensor 17. In the CCD line sensor 17, a plurality of reading elements are arranged in the Y direction (nozzle arrayed direction) so that the reading width defined by these reading elements coincides with the printing width of the printhead 14. The reading elements respectively read the first and second patterns from a sheet (printing medium) during conveyance.

Figure 8:
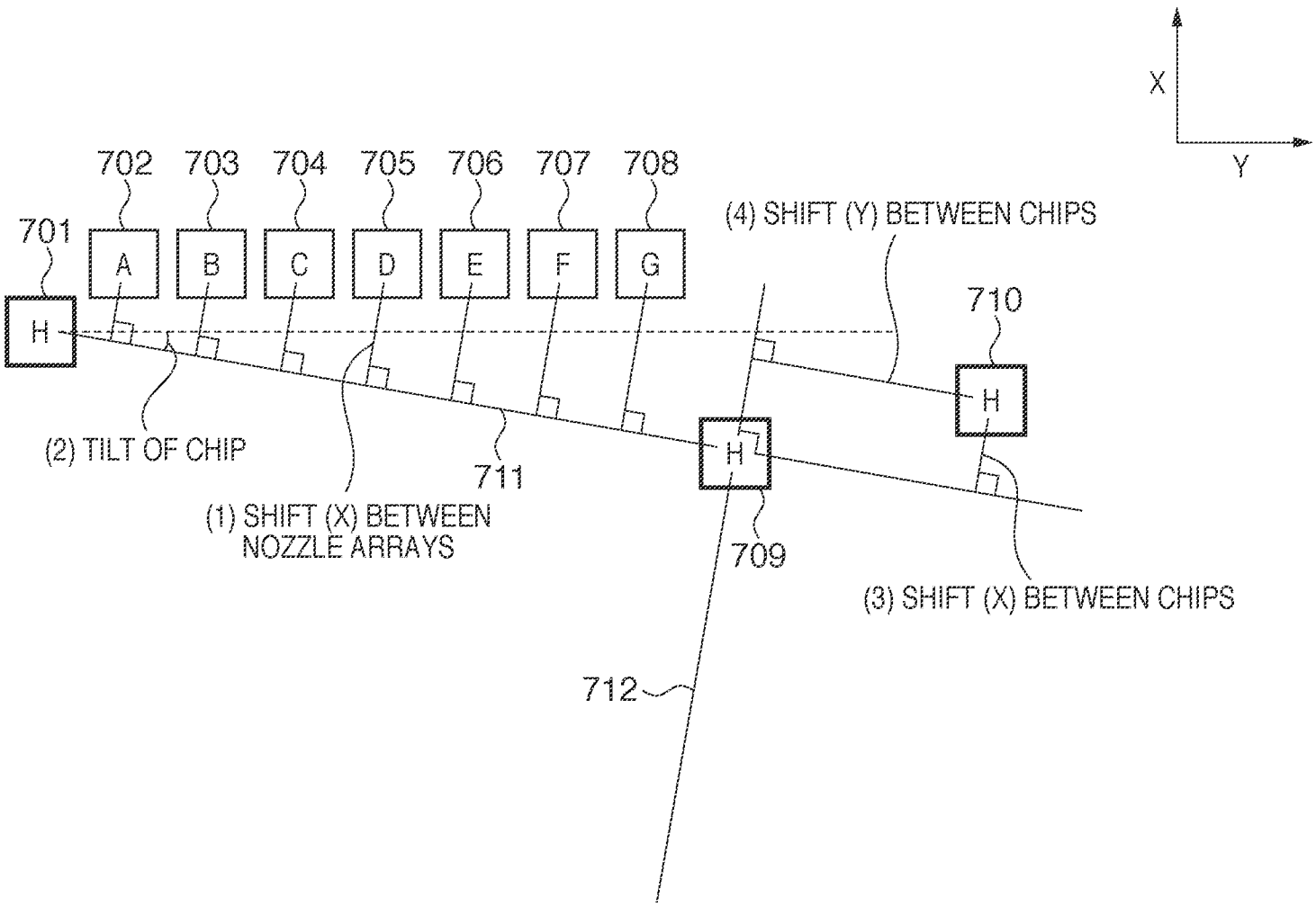
FIG. 8 is a view for explaining a method of calculating a shift amount.

A method of calculating the amount of shift generated in a single printhead will be explained with reference to FIG. 8. This shift amount is obtained based on the positional relationship between the tile patterns of each of the individual patterns 501 to 504 in FIG. 5.

The following shift amounts are calculated based on the tile patterns of each of the individual patterns 501 to 504:

1. the shift (X) between nozzle arrays
2. the tilt of a chip
3. the shift (X) between chips
4. the shift (Y) between chips All the tile patterns are printed with the same pattern. Thus, pattern matching is executed between the tile patterns, and the distance (number of pixels) between most highly correlated patterns among the tile patterns is calculated. Various shift amounts are calculated from the difference between the number of pixels between tile patterns at ideal positions, and the calculated number of pixels between tile patterns. Note that pattern matching suffices to employ a general method as disclosed in Japanese Patent Laid-Open No. 2010-105203.

The shift (X) between nozzle arrays is obtained by calculating the shift amounts of tile patterns printed by the remaining nozzle arrays with respect to a tile pattern printed by the nozzle array H. Tile patterns 701 to 709 are printed by the same chip, and a tile pattern 710 is printed by an adjacent chip.

When calculating the shift amount (X) of the nozzle array A with respect to the nozzle array H, a perpendicular is drawn from the tile pattern 702 printed by the nozzle array A to a straight line 711 which connects the tile patterns 701 and 709 printed by the nozzle array H. The distance of the perpendicular is calculated to calculate the difference from a distance at an ideal position. As a result, the shift amount (X) of the nozzle array A with respect to the nozzle array H is calculated. The shift amounts of the nozzle arrays B to G with respect to the nozzle array H can also be calculated in the same way. By using, as a reference, the line 711 which connects the tile patterns 701 and 709 printed by the nozzle array H, the influence of a skew in printed pattern reading can be removed.

The tilt of a chip can be obtained by calculating the tilt of the straight line 711 from the CCD line sensor 17. As for the shift (X) between chips, a perpendicular is drawn to the straight line 711 from the tile pattern 710 printed by an adjacent chip, the distance of the perpendicular is calculated, and the difference from a distance at an ideal position is calculated. Accordingly, the X shift amount between adjacent chips can be calculated.

As for the shift (Y) between chips, a straight line 712 perpendicular to the line 711 of force is drawn through the tile pattern 709, and a perpendicular is drawn from the tile pattern 710 to the straight line 712. The distance of the perpendicular is calculated to calculate the difference from a distance at an ideal position. The Y shift amount between adjacent chips can therefore be calculated.

Figure 9:
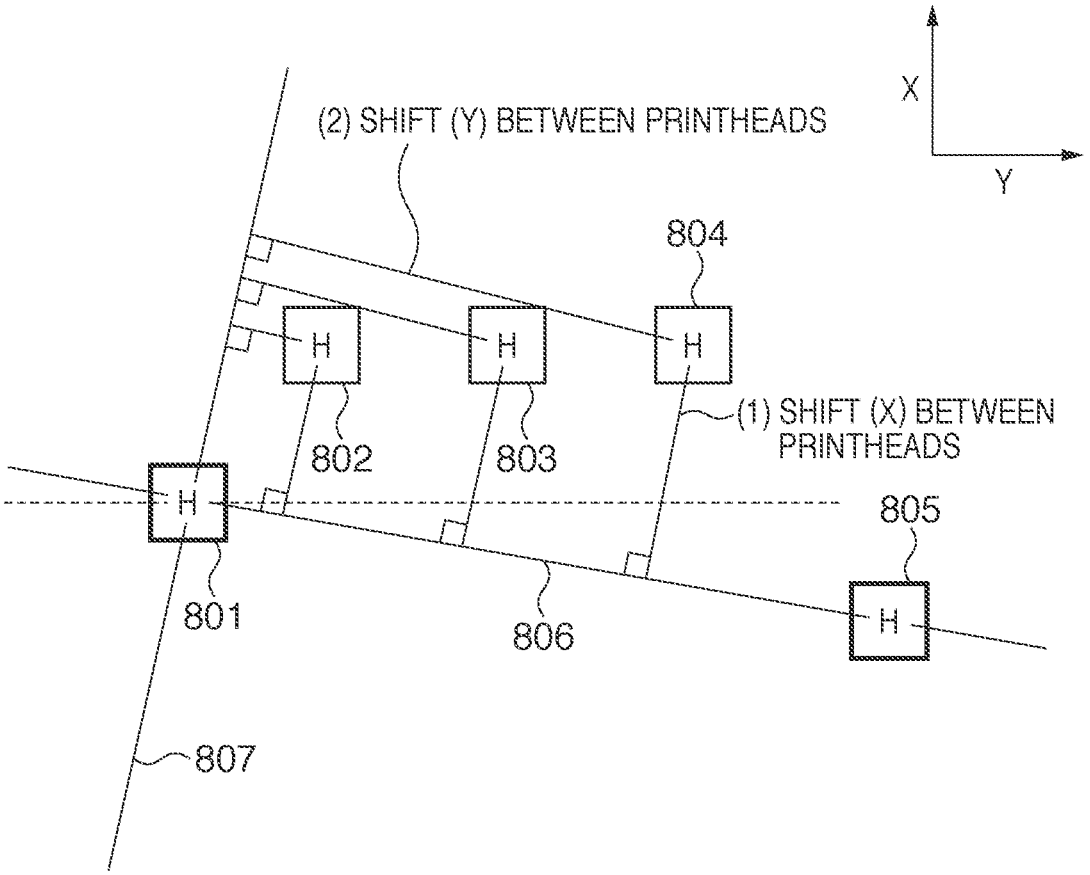
FIG. 9 is a view for explaining a method of calculating a shift amount.

A method of calculating the shift amount between a plurality of printheads will be explained with reference to FIG. 9. This shift amount is obtained based on the positional relationship between the individual patterns (tile patterns) 505 in FIG. 5. A case in which the shift amount between printheads is obtained will be described. In the first embodiment, the shift amount between printheads is obtained by calculating the shift amount of a tile pattern printed by each printhead with respect to a tile pattern printed by the black (K) printhead.

A perpendicular is drawn from a tile pattern 802 printed by the cyan (C) printhead to a straight line 806 which connects tile patterns 801 and 805 printed by nozzle array H of the black (K) printhead, and the length of the perpendicular is calculated. The difference between the calculated length and the distance at an ideal position is calculated as the shift amount (X) of the cyan (C) printhead with respect to the black (K) printhead.

Also, a straight line 807 perpendicular to the straight line 806 is drawn from the tile pattern 801, a perpendicular is drawn from the tile pattern 802 to the straight line 807, and the length of the perpendicular is calculated. The difference between the calculated length and the distance at an ideal position is calculated as the shift amount (Y) of the cyan (C) printhead with respect to the black (K) printhead. Similar to the cyan (C) printhead, the shift amounts (X) and (Y) of the magenta (M) and yellow (Y) printheads with respect to the black (K) printhead can be calculated.

The tile patterns are aligned in a direction (Y direction) parallel to the alignment of reading elements in the CCD line sensor 17 of the inspection unit 5. Even if the size of a read image changes owing to a conveyance error, all the tile patterns in, for example, the individual pattern 501 within the read image also change in the same manner, so the relative sizes of the tile patterns hardly change. Hence, the distance between tile patterns can be measured at high precision. This layout can decrease even the pattern length.

A method of correcting, based on the calculated shift amount, a shift of the landing position of ink discharged from the nozzle of each printhead will be described.

The shift (X) between nozzle arrays is corrected by changing the discharge timing of ink from each nozzle based on the shift amount with respect to the nozzle array H. As a consequence, a shift of the landing position of ink from each nozzle array with respect to the nozzle array H is corrected.

When correcting the tilt of a chip, a tilt from the printhead K is calculated from the tilt of each printhead from the inspection unit 5. Then, the tilts of the remaining printheads from the black (K) printhead are adjusted, correcting the shift between the printheads. The tilt of a chip is corrected by shifting print data (dot data) in the conveyance direction in accordance with the tilt. More specifically, it suffices to adopt a method disclosed in Japanese Patent Laid-Open No. 2009-006676.

The shift (X) between chips is corrected by changing the discharge timings of the chips 32 to 38 with respect to the chip 31. More specifically, the shift amount between adjacent chips is calculated, and the discharge timings of all the nozzle arrays of the chip 32 are uniformly corrected with respect to the chip 31, based on the shift amount between the chips. As for the chip 33, correction is done by the correction amount of the chip 32 with respect to the chip 31, in addition to correction of a shift amount with respect to the chip 32. The chips 33 to 38 are similarly corrected.

Figure 10:
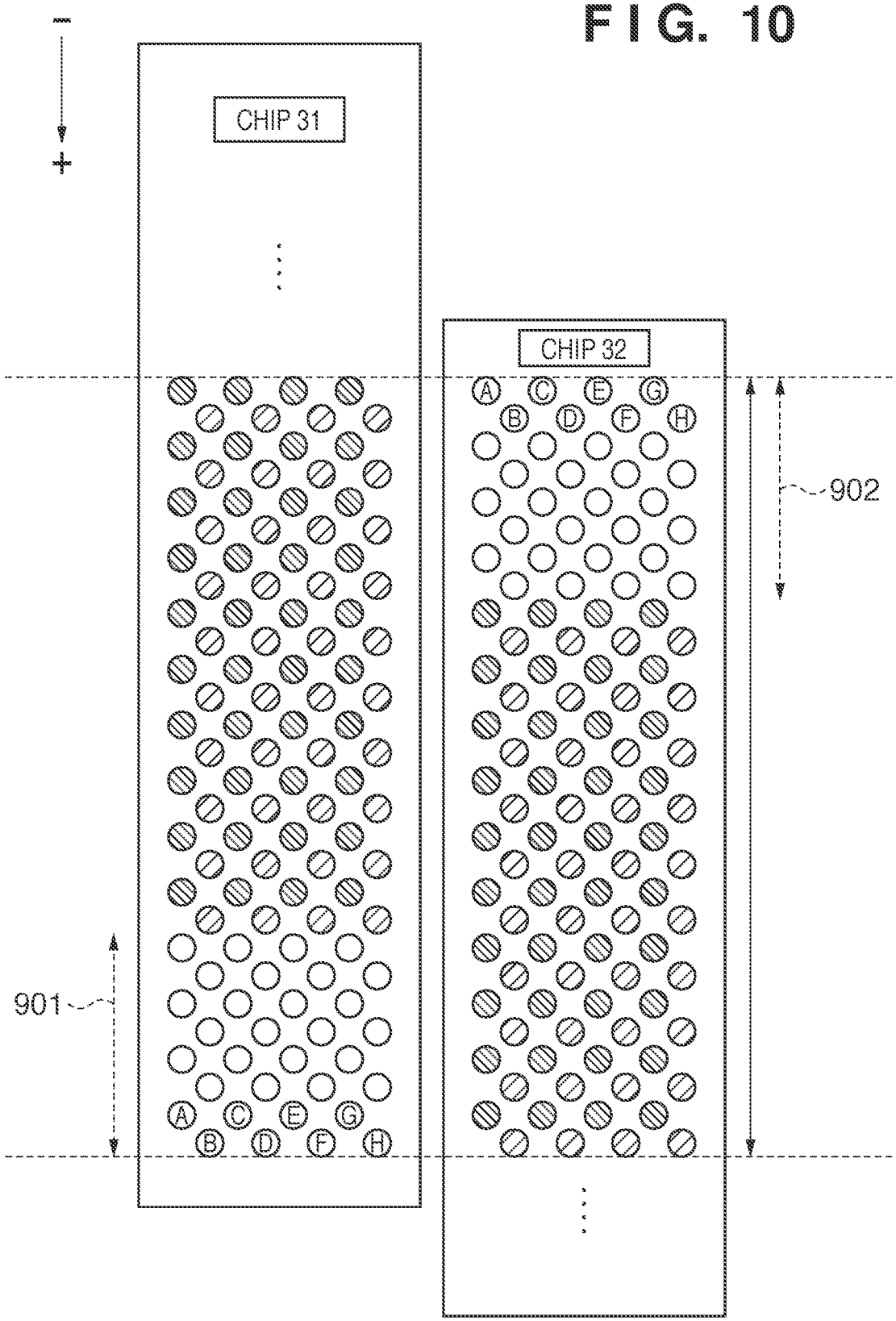
FIG. 10 is a view for explaining a print data shift method.

The shift (Y) between chips is corrected by shifting the use nozzle region. FIG. 10 is an enlarged view of the overlapping portion between chips. On each of the eight nozzle arrays, nozzles are aligned at a resolution of, for example, 1,200 dpi. The nozzle arrays are arranged with a shift of 2,400 dpi between the array A/C/E/G and the array B/D/F/H.

Figure 11:
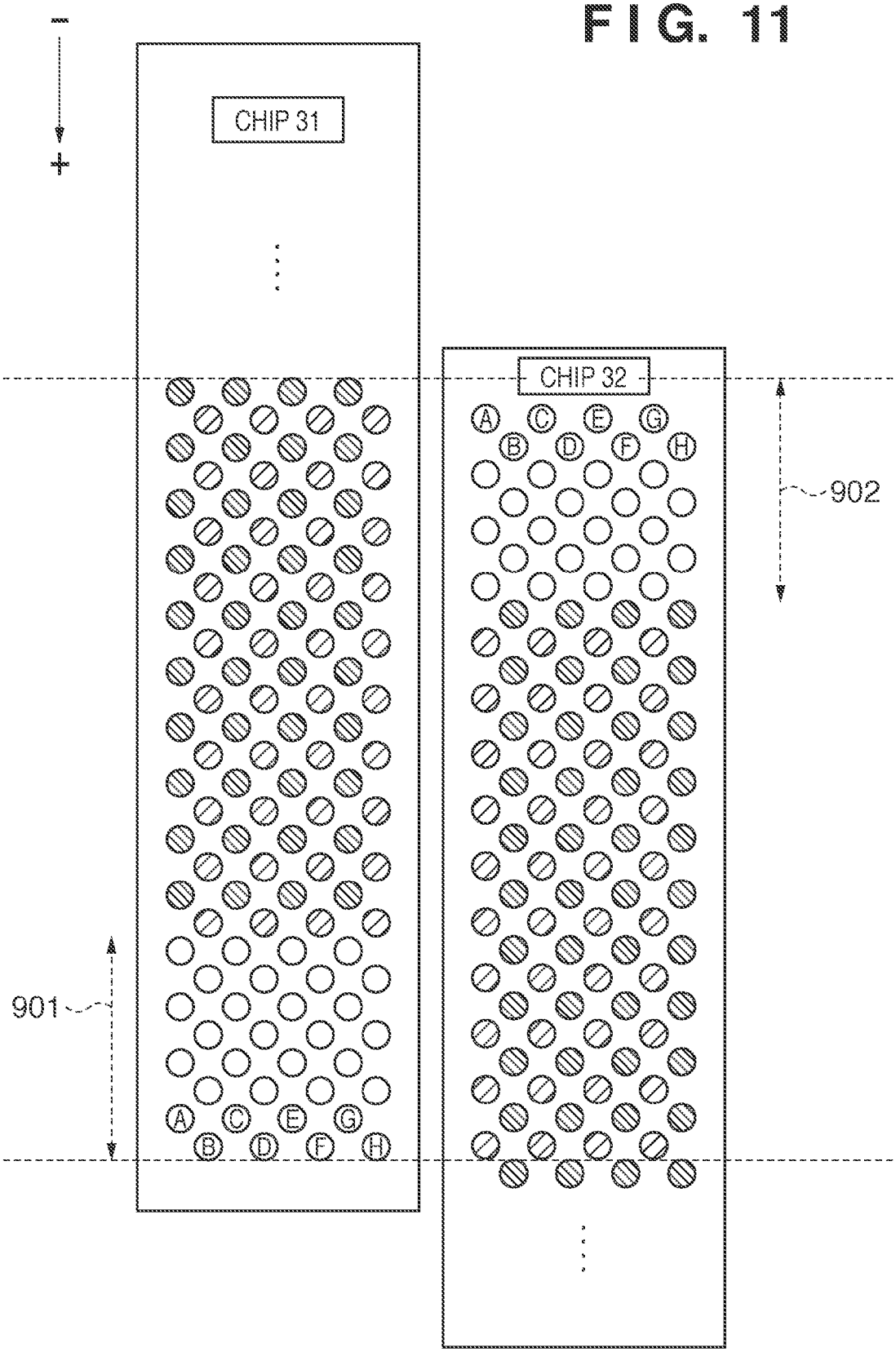
FIG. 11 is a view for explaining a print data shift method.

Adjustment nozzles (preliminary nozzles) 901 and 902 are used to shift nozzles. When the position of the chip 32 shifts from the chip 31 by 2,400 dpi in the positive direction, the relationship between orifices and print data is changed as shown in FIG. 11. More specifically, print data of all the arrays of the chip 32 are shifted by one nozzle (1,200 dpi) in the negative direction. Further, print data are exchanged between the arrays A and B, between the arrays C and D, between the arrays E and F, and between the arrays G and H, thereby performing correction at an interval of 2,400 dpi.

Figure 12:
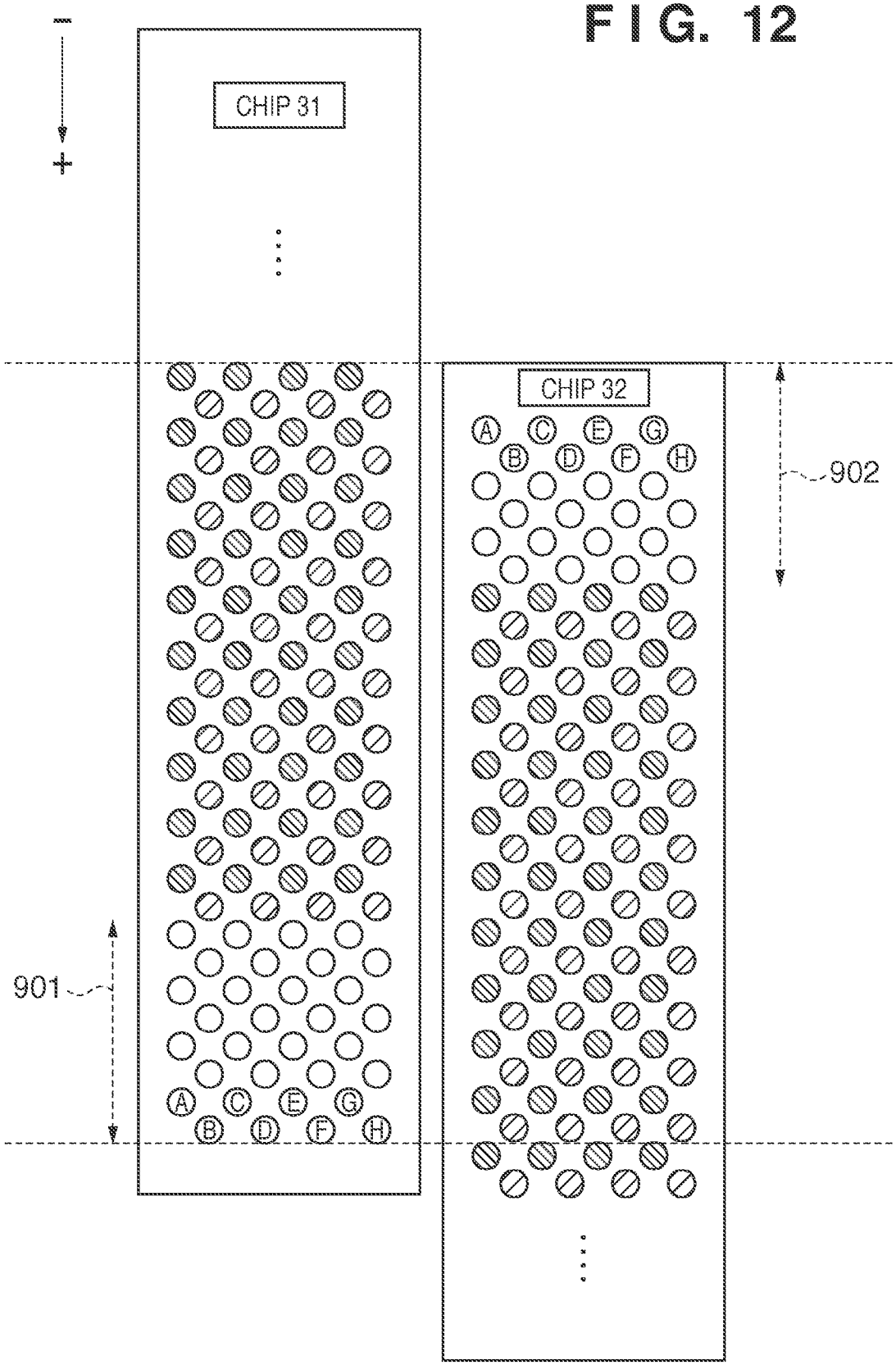
FIG. 12 is a view for explaining a print data shift method.

When the position of the chip 32 shifts from the chip 31 by 1,200 dpi in the positive direction, the relationship between orifices and print data is changed as shown in FIG. 12. More specifically, print data of all the arrays of the chip 32 are shifted by one nozzle (1,200 dpi) in the negative direction, thereby performing correction at an interval of 1,200 dpi.

As for correction of the shift (Y) between chips, similar to correction of the shift (X) between chips, all the chips are adjusted to the chip 31. The shift amount between adjacent chips is calculated to shift nozzles for use in the chip 32 with respect to the chip 31. As for the chip 33, correction is done by the correction amount of the chip 32 with respect to the chip 31, in addition to correction of a shift amount with respect to the chip 32. The chips 33 to 38 are also similarly corrected.

The shift (X) between printheads is corrected by correcting the discharge timing based on the shift amounts of the remaining printheads with respect to the black (K) printhead. As a result, the shifts of the remaining printheads in the X direction with respect to the black (K) printhead are corrected. Also, the shift (Y) between printheads is corrected by shifting nozzles for use based on the shift amounts of the remaining printheads with respect to the black (K) printhead. Therefore, the shifts of the remaining printheads in the Y direction with respect to the black (K) printhead are corrected. It suffices to shift nozzles for use by the same method as that when correcting the shift (Y) between chips.

As described above, according to the embodiment, the adjustment pattern (plurality of tile patterns) shown in FIG. 5 is read from a sheet during conveyance by using a sensor so configured that the reading width defined by a plurality of reading elements coincides with the printing width of the printhead. Then, shifts generated in a printhead and between a plurality of printheads are corrected based on the positional relationship between the read tile patterns.

Even if the size of a read image changes owing to a conveyance error, the sizes of the read tile patterns change in the same manner, so the relative sizes of the tile patterns hardly change.

For this reason, even if a printing medium conveyance shift occurs in adjustment pattern reading, the measurement error can be reduced.

A typical embodiment of the present invention has been exemplified. However, the present invention is not limited to the above-described and illustrated embodiments, and can be properly changed and modified without departing from the scope of the invention.

For example, in the above-described embodiment, the inspection unit 5 uses the CCD line sensor, but is not limited to this and may use a CMOS sensor.

In the above description, the tile patterns form a random pattern, but are not limited to it. Calculation and correction of the shift amount between nozzle arrays use the nozzle array H as a reference, but may use another nozzle array as a reference. Correction of the shift amount between chips uses the chip 31 as a reference, but may use another chip as a reference. Further, calculation of the tilt of a chip uses the black (K) printhead as a reference, but a tilt from the inspection unit 5 serving as a reference may be calculated. In addition, calculation and correction of the shift amount between printheads use the black (K) printhead as a reference, but may use another printhead as a reference. In the above description, the reading width defined by a plurality of reading elements in the CCD line sensor 17 coincides with the printing width of the printhead, but is not limited to this. For example, the reading width defined by a plurality of reading elements may cover at least part of the printing width of the printhead.

The printhead need not always employ the above-mentioned arrangement (see FIG. 4). For example, the overlapping portion may be omitted. It suffices to arrange nozzles on each chip so as to print by the entire width of a printing medium.

In the above description, the resolution of the nozzle array is 1,200 dpi, and the resolution between nozzles is 2,400 dpi. However, these resolutions are not limited to them and may be appropriately changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-176708 filed on Aug. 5, 2010, which is hereby incorporated by reference herein in its entirety.

What is claimed is:

1. A printing apparatus that includes a plurality of nozzle arrays each of which has a plurality of nozzles each discharging ink and being arrayed in a predetermined direction, and that prints on a printing medium by discharging ink from the respective nozzles of the plurality of nozzle arrays while moving the plurality of nozzle arrays and the printing medium relatively in an intersecting direction which intersects the predetermined direction, the apparatus comprising:

a control unit configured to control forming, on the printing medium by the plurality of nozzle arrays, of a plurality of patterns corresponding to the plurality of nozzle arrays respectively while moving the plurality of nozzle arrays and the printing medium relatively in the intersecting direction, such that the plurality of patterns formed on the printing medium are arrayed in the predetermined direction; and a determination unit configured to determine a shift amount of a relative printing position between the plurality of nozzle arrays in the intersecting direction, based on a reading result obtained by causing a reading unit to read the plurality of patterns while conveying the printing medium in the intersecting direction, the reading unit including a sensor which has a plurality of reading elements arranged in the predetermined direction such that a reading region that is read by the plurality of reading elements includes a forming region of the plurality of patterns in the predetermined direction, wherein the control unit controls forming of the plurality of patterns such that a first pattern and a second pattern among the plurality of patterns is formed by a first nozzle array among the plurality of nozzle arrays, and the determination unit determines the shift amount using a distance, in an image obtained from the reading result, between a pattern formed by a nozzle array which is different from the first nozzle array and a straight line which passes through the first pattern and the second pattern.

2. The apparatus according to claim 1, wherein color of ink discharged from nozzles is the same for the plurality of nozzle arrays.

3. The apparatus according to claim 1, wherein colors of ink discharged from nozzles are different from each other for the plurality of nozzle arrays.

4. The apparatus according to claim 3, further comprising a plurality of printheads in which colors of ink discharged from nozzles are different from each other, wherein the plurality of nozzle arrays are provided to the plurality of printheads, respectively.

5. The apparatus according to claim 1, wherein each of the plurality of patterns includes a plurality of dots which are randomly arranged, and the determination unit determines the shift amount using pattern matching between the plurality of patterns.

6. The apparatus according to claim 5, the plurality of patterns are formed with a same pattern.

7. The apparatus according to claim 1, wherein the determination unit adjusts, based on the shift amount, a timing for causing the nozzles of each of the plurality of nozzle arrays to discharge ink, such that the shift amount falls within an allowable range.

8. The apparatus according to claim 1, further comprising the reading unit.

9. A printing apparatus that includes a printhead which has a first nozzle array and a second nozzle array each of which has a plurality of nozzles each discharging the same color ink and being arrayed in a predetermined direction, the first nozzle array and the second nozzle array being arranged in an intersecting direction which intersects the predetermined direction so as to be shifted from each other in the predetermined direction to form an overlapping portion in which parts of each other are overlapped in the predetermined direction, and that prints on a printing medium by discharging ink from the respective nozzles of the first nozzle array and the second nozzle arrays while moving the printhead and the printing medium relatively in the intersecting direction, the apparatus comprising:

a control unit configured to control forming of a plurality of patterns on the printing medium by the first nozzle array and the second nozzle array while moving the printhead and the printing medium relatively in the intersecting direction, such that the plurality of patterns are arrayed in the predetermined direction, the plurality of patterns including patterns formed on the printing medium by the first nozzle array and patterns formed on the printing medium by the second nozzle array; and a determination unit configured to determine a shift amount of a relative printing position between the first nozzle array and the second nozzle array in the intersecting direction, based on a reading result obtained by causing a reading unit to read the plurality of patterns while conveying the printing medium in the intersecting direction, the reading unit including a sensor which has a plurality of reading elements arranged in the predetermined direction such that a reading region that is read by the plurality of reading elements includes a forming region of the plurality of patterns in the predetermined direction, wherein the control unit controls forming of the plurality of patterns such that a first pattern and a second pattern among the plurality of patterns is formed by the first nozzle array, and the determination unit determines the shift amount using a distance, in an image obtained from the reading result, between a pattern formed by the second nozzle array and a straight line which passes through the first pattern and the second pattern.

10. The apparatus according to claim 9, wherein each of the plurality of patterns includes a plurality of dots which are randomly arranged, and the determination unit determines the shift amount using pattern matching between the plurality of patterns.

11. The apparatus according to claim 10, the plurality of patterns are formed with a same pattern.

12. The apparatus according to claim 9, wherein the determination unit adjusts, based on the shift amount, a timing for causing the nozzles of each of the first nozzle array and the second nozzle array to discharge ink, such that the shift amount falls within an allowable range.

13. The apparatus according to claim 9, further comprising the reading unit.

14. A printing method for printing on a printing medium by discharging ink from each nozzle in a plurality of nozzle arrays each of which has a plurality of nozzles each discharging ink and being arranged in a predetermined direction, while moving the plurality of nozzle arrays and the printing medium relatively in an intersecting direction which intersects the predetermined direction, the method comprising:

controlling forming of a plurality of patterns corresponding to the plurality of nozzle arrays respectively on the printing medium by the plurality of nozzle arrays while moving the plurality of nozzle arrays and the printing medium relatively in the intersecting direction, such that the plurality of patterns formed on the printing medium are arrayed in the predetermined direction; and determining a shift amount of a relative printing position between the plurality of nozzle arrays in the intersecting direction, based on a reading result obtained by causing a reading unit to read the plurality of patterns while conveying the printing medium in the intersecting direction, the reading unit including a sensor which has a plurality of reading elements arranged in the predetermined direction such that a reading region that is read by the plurality of reading elements includes a forming region of the plurality of patterns in the predetermined direction, wherein in the controlling, forming of the plurality of patterns is controlled such that a first pattern and a second pattern among the plurality of patterns is formed by a first nozzle array among the plurality of nozzle arrays, and in the determining, the shift amount is determined using a distance, in an image obtained from the reading result, between a pattern formed by a nozzle array which is different from the first nozzle array and a straight line which passes through the first pattern and the second pattern.

15. The method according to claim 14, wherein color of ink discharged from nozzles is the same for the plurality of nozzle arrays.

16. The method according to claim 15, wherein the plurality of nozzle arrays is provided respectively to a plurality of printheads for which colors of ink discharged from nozzles are different from each other.

17. A printing method for a printing apparatus that includes a printhead which has a first nozzle array and a second nozzle array each of which has a plurality of nozzles each discharging the same color ink and being arranged in a predetermined direction, the first nozzle array and the second nozzle array being arranged in an intersecting direction which intersects the predetermined direction so as to be shifted from each other in the predetermined direction to form an overlapping portion in which parts of each other are overlapped in the predetermined direction, and that prints on a printing medium by discharging ink from the respective nozzles of the first nozzle array and the second nozzle arrays while moving the printhead and the printing medium relatively in the intersecting direction, the method comprising:

controlling forming of a plurality of patterns on the printing medium by the first nozzle array and the second nozzle array while moving the printhead and the printing medium relatively in the intersecting direction, such that the plurality of patterns are arrayed in the predetermined direction, the plurality of patterns including patterns formed on the printing medium by the first nozzle array and patterns formed on the printing medium by the second nozzle array; and determining a shift amount of a relative printing position between the first nozzle array and the second nozzle array in the intersecting direction, based on a reading result obtained by causing a reading unit to read the plurality of patterns while conveying the printing medium in the intersecting direction, the reading unit including a sensor which has a plurality of reading elements arranged in the predetermined direction such that a reading region that is read by the plurality of reading elements includes a forming region of the plurality of patterns in the predetermined direction, wherein in the controlling, forming the plurality of patterns is controlled such that a first pattern and a second pattern among the plurality of patterns is formed by the first nozzle array, and in the determining, the shift amount is determined using a distance, in an image obtained from the reading result, between a pattern formed by the second nozzle array and a straight line which passes through the first pattern and the second pattern.

* * * * *